US006357196B1

(12) United States Patent
McCombs

(10) Patent No.: US 6,357,196 B1
(45) Date of Patent: Mar. 19, 2002

(54) PULTRUDED UTILITY POLE

(76) Inventor: M. Scott McCombs, 356 Clark Dr., Henderson, NV (US) 89014

( * ) Notice: Subject to any disclaimer, the term of this patent is extended or adjusted under 35 U.S.C. 154(b) by 0 days.

(21) Appl. No.: 09/303,092

(22) Filed: Apr. 29, 1999

Related U.S. Application Data

(63) Continuation-in-part of application No. 08/850,780, filed on May 2, 1997, now abandoned.

(51) Int. Cl.[7] ..... E04C 3/30

(52) U.S. Cl. ..... 52/736.2; 52/309.11; 52/514; 52/736.1; 52/737.2; 138/166; 138/167; 285/331; 285/373; 405/216

(58) Field of Search ..... 52/736.3, 736.4, 52/737.4, 737 J, 738.1, 736.2, 737.2, 301, 309.1, 309.9, 309.11, 514, 101; 138/128, 168, 162, 169, 166; 285/330, 373, 383, 331; 405/216, 211

(56) References Cited

U.S. PATENT DOCUMENTS 3,757,031 A * 9/1973 Izraeli ..... 174/138 F
4,222,576 A * 9/1980 Clements ..... 277/237
4,306,821 A * 12/1981 Moore ..... 405/216
4,388,787 A * 6/1983 Milbright ..... 52/298
4,708,527 A * 11/1987 Inhofe, Jr. et al. ..... 405/216
4,713,129 A * 12/1987 Inhofe, Jr. et al. ..... 156/71
4,779,389 A * 10/1988 Landers ..... 52/169.13
4,803,819 A * 2/1989 Kelsey ..... 52/309.1
4,850,397 A * 7/1989 Grenier ..... 138/149
5,311,713 A * 5/1994 Goodrich ..... 52/301
5,358,283 A * 10/1994 Silva ..... 285/24

* cited by examiner

*Primary Examiner*—Carl D. Friedman
*Assistant Examiner*—Yvonne M. Horton
(74) *Attorney, Agent, or Firm*—Quirk & Tratos

(57) ABSTRACT

A hollow fiberglass utility pole includes a pair of segments that are a fiberglass sheet that has a semicircular cross-section. The segments have first and second longitudinal edges with male and female couplers respective shapes that have a complimentary relationship to each other for mechanical engagement thereof. The fiberglass pole is assembled by engaging the first longitudinal edge of one segment with the second longitudinal edge of the other segment at an installation site. The fiberglass pole may be used as a sheath to encase an existing wooden pole.

3 Claims, 3 Drawing Sheets

PULTRUDED UTILITY POLE

CROSS REFERENCE TO RELATED APPLICATION

This application is a Continuation-In-Part Application of commonly owned application Ser. No. 08/850,780 filed May 2, 1997 and titled "Pultruded Utility Pole" now abandoned.

FIELD OF THE INVENTION

The present invention relates generally to utility poles and, more particularly, to a plurality of pultruded segments adapted to be assembled to define a pole, such as a power pole and which may be assembled to encase a standing wooden pole.

DESCRIPTION OF THE PRIOR ART

A wooden utility pole of a type that is found in almost every rural and urban area is typically made from a tree that has been harvested from a forest. Either creosote, or a similar preservative, is usually applied to the wooden pole to prevent rotting due to insect infestation. It should be understood that creosote is a carcinogen.

Electric power as well as video and telephone signals are typically transmitted via a wire supported by a plurality of wooden utility poles. Historically, there has been an increasing demand for the electric power as well as television and telephone service that has caused an increased use of the wooden poles. A result of the increased use has been a correspondingly increased harvesting of trees that has caused an environmentally undesirable deforestation. Therefore, it is desirable to use materials, other than wood, from which to make a utility pole.

U.S. Pat. No. 5,513,477 to Farber, for example, discloses a hollow utility pole that is formed from a plurality of similar segments of a fiber/resin composite. The thickness of the segments is minimized to correspondingly minimize the weight of the segments.

The composite utility pole is formed by bonding together a side face of one segment to a side face of the other segment about a hollow inner tube, the length and wall thickness of which varies according to the desired strength and stiffness properties. External, molded, reinforcing members are adhesively bonded to the exterior of the inner tube. It should be appreciated that the side faces have a width that substantially equals the thickness of the segments. Because of the minimized thickness, the bonding may not be over an area large enough to provide adhesion necessary for the composite pole to withstand environmentally induced structural stresses due to adverse weather conditions for example. Further the molded outer segments, because of the size of the molds, may require that the segments be stacked and adhesively bonded along the length of the reinforced tube. Thus the technique of this reference typically requires production of the inner tube, which could be pultruded, molding the outer segments and bonding the elements together.

In Kelsey, U.S. Pat. No. 4,803,819 discloses a pultruded power pole of a one piece construction which includes internal, reinforcing, struts. The one piece construction may, due to weight, preclude shipment along roadways or use in some situations.

When an old wooden utility pole is removed and replaced, it is preferably disposed of in an economically feasible manner with a reduced probability that the carcinogenic creosote in the old pole will seep into the ground and groundwater supply. Hence, old wooden pole may be required to be disposed of at an appropriate toxic disposal site. The cost of the disposal of the removed wooden pole increases the cost of replacement and also imposes a societal cost of constructing and maintaining toxic disposal sites.

Heretofore, there has not been a suggestion in the prior art of a utility pole made from connected non-wooden segments that can reliably withstand the environmentally induced structural stresses. Additionally, the prior art is silent as to how to avoid removal and replacement of deteriorated wooden poles in such a manner as to avoid disposal costs and the filling of toxic disposal sites with wooden poles.

SUMMARY OF THE INVENTION

There is provided, according to one aspect of the present invention, a pole which is produced by assembling, in situ, a plurality of pultruded segments each having a longitudinal length corresponding to the desire length of the pole. Each segment has longitudinally extending edges including male and female couplers to mechanically couple the segments together to define the pole. Preferably, the male and female couplers have a constant diametrical cross-section to be consistent with pultrusion.

In another aspect, a method is set forth which includes assembling the pole according to the present invention about a standing wooden pole to re-enforce and encase the pole.

BRIEF DESCRIPTION OF THE DRAWING

These and other features and advantages will become better appreciated as the same becomes better understood with reference to the description, claims and drawings wherein:

DESCRIPTION OF THE PREFERRED EMBODIMENT

In the preferred embodiment, a fiberglass utility pole is comprised of a pair of pultruded segments and an end cap. In an alternative embodiment the segments are made from a fiber/resin composite other than fiberglass.

Because the segments are pultruded, they may be made to almost any desired length in that the segments are drawn through a mold. As explained hereinafter, when a wooden utility pole is being replaced, the fiberglass pole is used as a sheath to encase the wooden pole, thereby obviating the cost of removal of the wooden pole.

Figures 1, 2, 3:
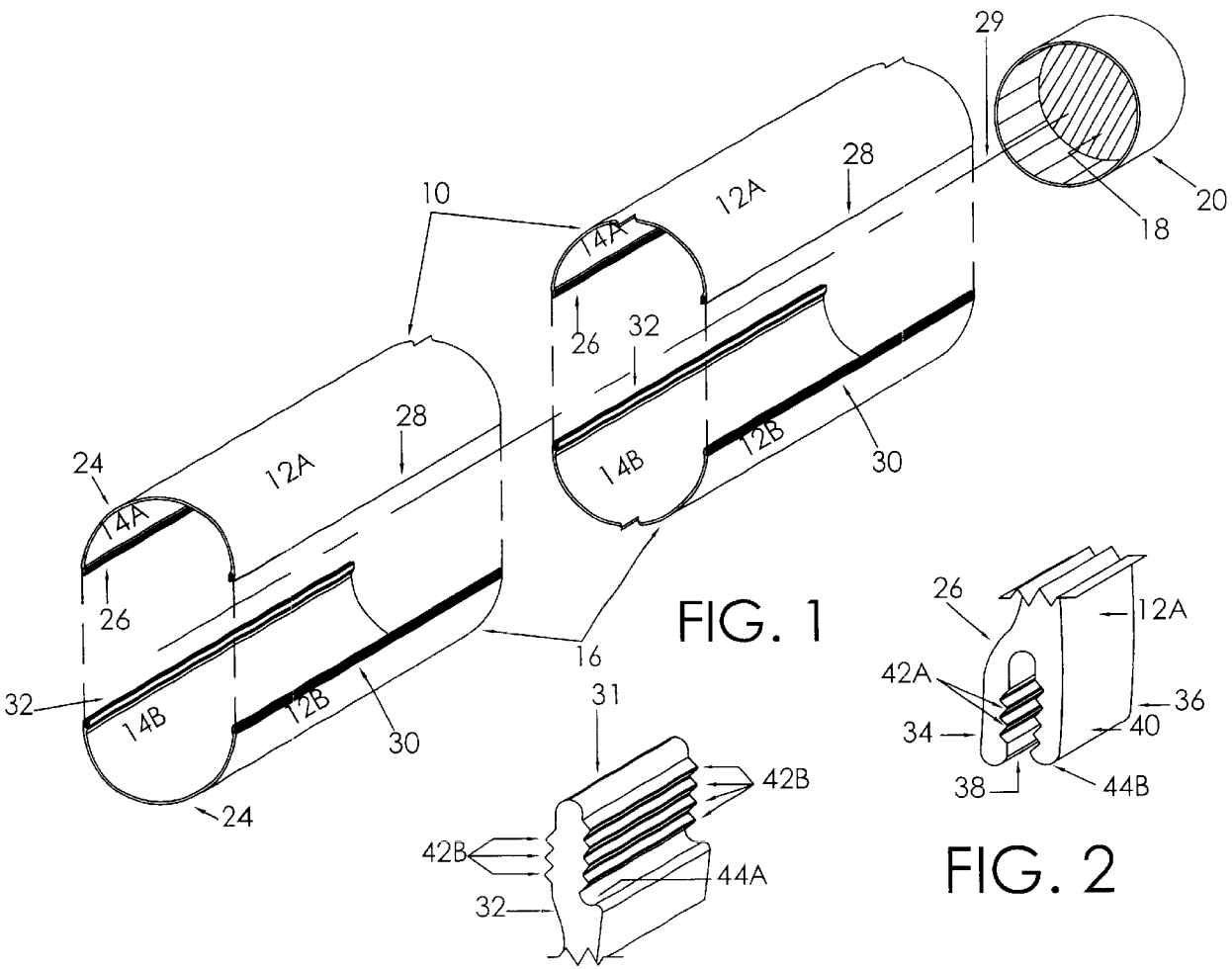
FIG. 1 is a perspective exploded view of the preferred embodiment of the present invention.
FIG. 2 is an perspective view of a portion of an edge of one of two segments in the embodiment of FIG. 1.
FIG. 3 is a perspective view of a portion of an edge of the other of the two segments in the embodiment of FIG. 1.

As shown in FIG. 1, a fiberglass utility pole includes a segment 10 comprised of a fiberglass sheet that has a semicircular cross-section and is pultruded to an uniterrupted longitudinal length corresponding to the length of the pole. The segment 10 has an outside surface 12A and an inside surface 14A.

The fiberglass pole additionally includes a segment 16 similar to the segment 10. The length of the segments 10, 16 substantially equals a desired, longitudinal length of the fiberglass pole, which is typically on the order of 40 feet. The thickness of the segments 10, 16 is preferably 0.25 inches.

The outside surface 12A typically has a radius of curvature of 7.5 inches. Accordingly, when the fiberglass pole is assembled, it is a hollow cylinder with an outside diameter of 15 inches. Because of the 0.25 inch thickness and the 15 inch diameter, the fiberglass pole is not excessively heavy yet has a desired strength and stiffness. It should be understood that in alternative embodiments the fiberglass pole may be other than cylindrical and may be fashioned using three or more segments.

A disc shaped end cap 18 that has a flange 20 is connected to a top end 22 of the fiberglass pole, whereby the top end 22 is covered. Similar to most utility poles, a bottom end 24 of the fiberglass pole is typically buried six feet below ground.

The segment 16 has an outside surface 12B and an inside surface 14B that are respectively similar to the surfaces 12A, 14A. When the fiberglass pole is assembled, the surfaces 12A, 12B and the surfaces 14A, 14B are its outside and inside surfaces, respectively.

The segment 10 has a longitudinally extending edge 26 with a shape that has a complimentary relationship to the shape of an edge 28 of the segment 10. Because the edges 26, 28 are longitudinal, they are parallel to a central axis 29 of the segment 10.

Edges 30, 32 of the segment 16 are similar to the edges 26, 28, respectively. Hence, the shape of the edges 26, 28 are respectively complimentary to the shape of the edges 32, 30 for mating engagement as hereinafter described.

Figure 4:
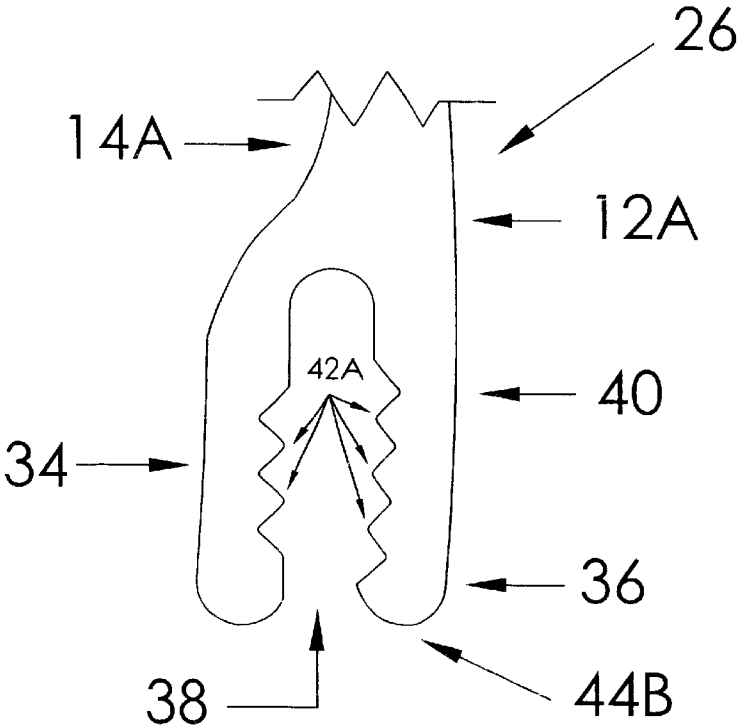
FIG. 4 is an end view of the edge of FIG. 2.

As shown in FIGS. 2 and 4, the edge 26 includes ledges 34, 36 that define a female coupler 38. A surface 40 of the ledge 36 has a radius of curvature substantially equal to the radius of curvature of the surface 12A. Within the female coupler 38, the ledges 34, 36 carry lengthwise ridges 42A (FIG. 4) that have a triangular cross-section. The diametrical cross-section of the female coupler 38 is consistent along the length of the segment 10 to be fashioned through the pultrusion process of formation of the segment 10.

Figure 5:
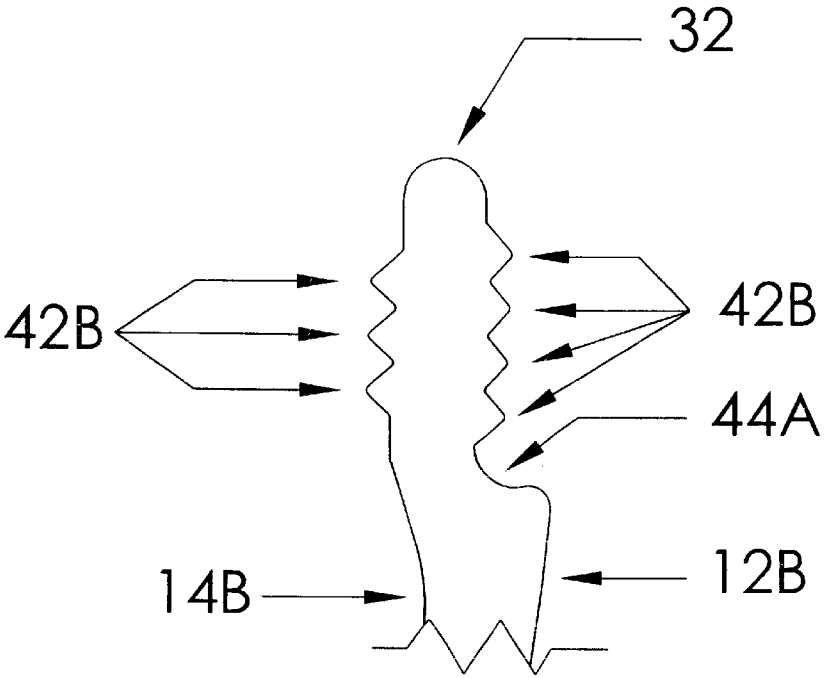
FIG. 5 is an end view of the edge of FIG. 3.

As shown in FIGS. 3 and 5, the edge 32 is a protrusion that carries a male coupler 31 including lengthwise teeth 42B that have a triangular cross-section. Moreover, the male coupler 31 is offset from the surfaces 12B, 14B to define a recess 44A. Again the diametrical cross-section of the male coupler 31 is consistent along the length of the segment 16 to be fashioned by pultrusion. Because of the elasticity of fiberglass, the fiberglass pole can be assembled by snapping the male coupler 31 into the female coupler 38 whereby the edges 26, 32 are snapped together. In that the male and female couplers 31, 38 are consistent along the length of the segments 10, 16, the mechanical connection between the edges 26, 32 extends along the entire length of the pole.

Because of the complimentary relationship, when the male coupler 31 is snapped into the female coupler 38, the ridges 42A mesh with the ridges 42B and an end 44B (FIGS. 2 and 4) of the ledge 36 rests within the recess 44A. The complimentary relationship additionally causes the surfaces 12A, 12B to be substantially a single surface with a constant radius of curvature. The edges 28, 30 are snapped together in a manner similar to that described in connection with the edges 26, 32.

In an alternative embodiment, the fiberglass pole is made from more than two segments. When the fiberglass pole is made from three similar segments, for example, the three segments are each comprised of a fiberglass sheet that has a cross-section that subtends a 120 degree arc. Moreover, the three segments have longitudinal edges with shapes that have the complimentary relationship described hereinbefore.

As can be appreciated, the segments 10, 16 can be shipped to the desired location and assembled at the site by engaging the male and female couplers 31, 38 and thereafter lifting or tilting the assembled pole into position. Further the mechanical connection dispenses with the need to use adhesive bonding or the like. Still further, in that the segments 10, 16 are pultruded, the consistent diametrical cross-section of the male and female couplers accommodates pultrusion.

The construction of the pole as described above is not only suited to be a free standing utility, power, light or other pole but can also be used to encase a standing wooden pole which may be deteriorated thus obviating the necessity of removing and disposing of the wooden pole.

Accordingly, the base of the standing wooden pole is excavated to a location below grade for example to a depth to provide support for the encasing pole and perhaps to a depth below ground residing insects. The segments 10, 16 are fashioned in the manner described above to longitudinal lengths corresponding to the length of the wooden pole to the below grade location. The segments 10, 16 are assembled about the standing wooden pole, whereby the fiberglass pole becomes a sheath to encase and provide structural support to the wooden pole. In other words, the replaced wooden pole remains in place where it is encased within the fiberglass pole. The excavation is then backfilled to provide support to the standing, encased, pole. If desired, concrete may be poured about the encased pole to provide additional structural support thereto.

Hence, a deteriorated wooden pole need not be removed and disposed of. This can result in substantial savings for a utility company in labor and disposal costs.

Figure 6:
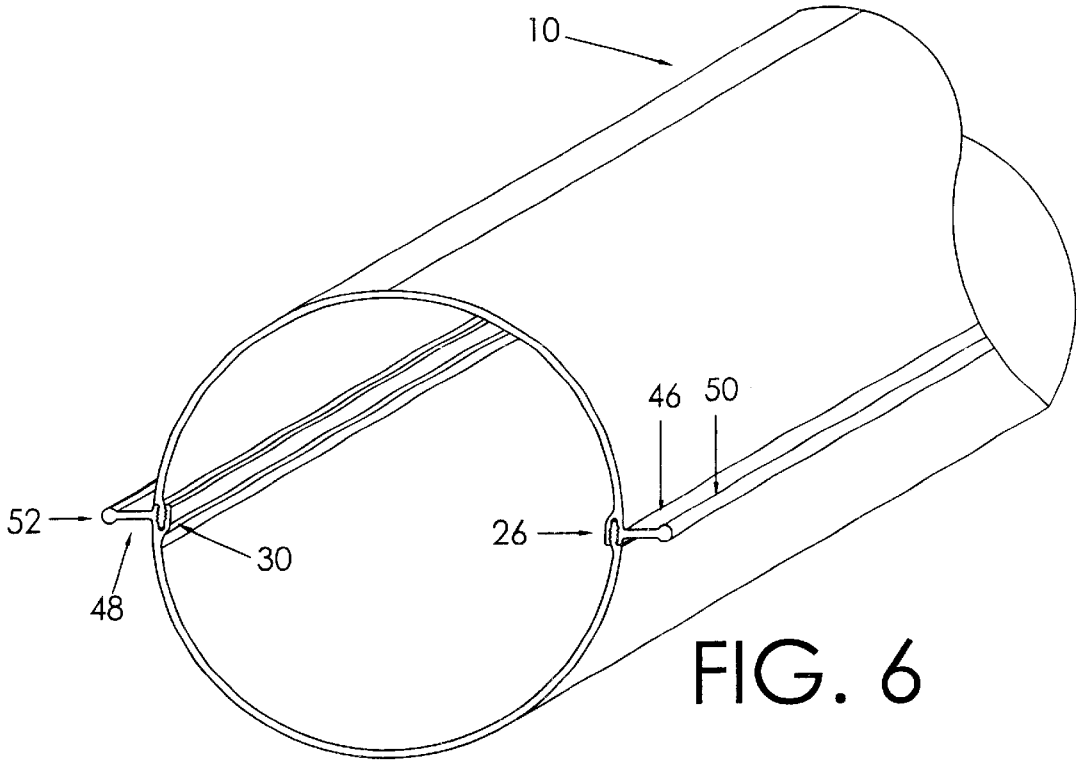
FIG. 6 is a perspective view of an embodiment of the invention whereon a pair of utility rails are carried.
Figure 7:
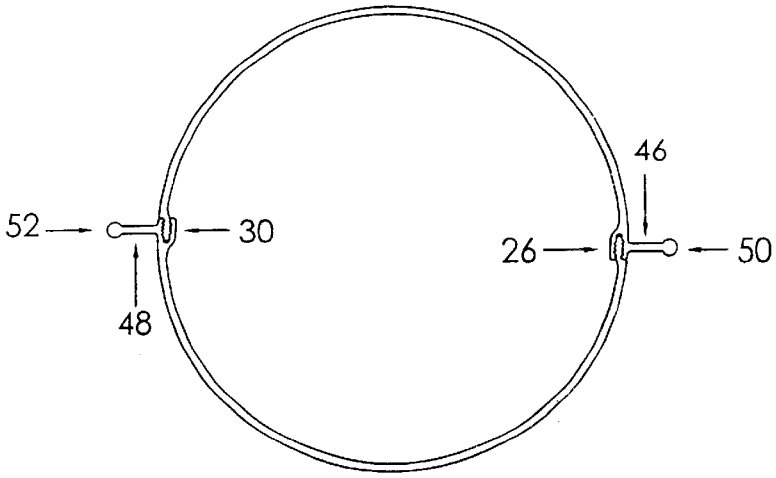
FIG. 7 is an end view of the of the embodiment of FIG. 6.

As shown in FIGS. 6 and 7, the fiberglass pole preferably includes utility rails 46, 48 that are integrally connected to the edges 26, 30, respectively. The rails 46, 48 are generally rectangular with the approximate thickness of the segments 10, 16. The rails 46, 48 extend radially from the fiberglass pole and are respectively disposed lengthwise along the segments 10, 16.

The rails 46, 48 may include ridges 50, 52, respectively. The ridge 50 extends along a lengthwise edge of the rail 46. Similarly, the ridge 52 extends along a lengthwise edge of the rail 48. The rails 46, 48 facilitate the mounting of equipment that may be used, for example, by a person to climb the fiberglass pole.

While the invention has been particularly shown and described with reference to a preferred embodiment thereof, it should be understood by those skilled in the art that changes in form and detail may be made therein without departing from the spirit and scope of the invention.

I claim:

1. A hollow structure adapted to be assembled to form a pole at the desired location of erection, comprising:

a plurality of pultruded, resin and fiberglass composite segments each having an uninterrupted desired longitudinal length corresponding to the desired length of said pole, each segment including longitudinally extending edges conformed for mating with corresponding opposed edges of the other ones of said segments for defining said hollow pole;

said opposed edges including longitudinally extending male and female couplers to mechanically couple said edges together to secure the segments together to define said pole;

said male coupler includes a plurality of longitudinally extending teeth and said female coupler includes said channel including a plurality of longitudinally extending locking surfaces to receive by resilient expansion said male coupler and be engaged by said teeth;

said male coupler being shaped as an insert including said teeth on both sides thereof; and at least one longitudinally extending rail projecting radially from at least one segment for mounting fixtures thereon.

2. The pole of claim 1 wherein said pole is cylindrical and each segment is semi-cylindrical.

3. An assembly conformed for interlocking attachment to form a hollow cylindrical structure, comprising:

a plurality glass reinforced resin composite segments each formed to define one position of an arc of a cylindrical surface and each including a first and second longitudinal edge, said first longitudinal edge having a longitudinal cavity provided with a plurality of opposed first teeth in the interior thereof and said second longitudinal edge being provided with a longitudinal projection having a plurality outwardly directed second teeth on the exterior thereof, said longitudinal projection in one said segment being conformed to resilient receipt in said longitudinal cavity of another one of said segment and, a radial projection aligned generally radially on the exterior of said tubular structure along each said first longitudinal edge of each said segment, whereby an interlocked engagement between said first and second teeth provides an engagement of said segments to each other to form a tubular structure.

* * * * *